US005638875A

United States Patent [19]

Corfitsen

[11] Patent Number: 5,638,875

[45] Date of Patent: Jun. 17, 1997

[54] APPARATUS FOR AUTOMATIC REFUELLING OF VEHICLES

[76] Inventor: Sten Corfitsen, Rådlursvägen 1, 5-181 43 Lidingo, Sweden

[21] Appl. No.: 392,916

[22] PCT Filed: Sep. 3, 1993

[86] PCT No.: PCT/SE93/00717

§ 371 Date: Mar. 3, 1995

§ 102(e) Date: Mar. 3, 1995

[87] PCT Pub. No.: WO94/05592

PCT Pub. Date: Mar. 17, 1994

[30] Foreign Application Priority Data

Sep. 4, 1992 [SE] Sweden ..... 9202549

[51] Int. Cl.[6] ..... B67D 5/08

[52] U.S. Cl. ..... 141/360; 141/94; 141/98; 141/231; 141/284; 141/354; 141/386; 901/6; 901/16; 901/41; 901/46

[58] Field of Search ..... 141/94, 98, 198, 141/231, 232, 284, 351–355, 360–362, 383, 386; 901/6, 16, 41, 45, 46

[56] References Cited

U.S. PATENT DOCUMENTS

| | | | |
|---|---|---|---|
| 3,642,036 | 2/1972 | Ginsburgh et al. | 141/94 |
| 4,681,144 | 7/1987 | Horvath et al. | 141/1 |
| 4,881,581 | 11/1989 | Hollerback | 141/98 X |

FOREIGN PATENT DOCUMENTS

| | | |
|---|---|---|
| 0239193 | 9/1987 | European Pat. Off. . |
| 0418744 | 3/1991 | European Pat. Off. . |
| 9013512 | 11/1990 | WIPO . |

OTHER PUBLICATIONS

The above art was cited in the International Search Report.

*Primary Examiner*—J. Casimer Jacyna
*Attorney, Agent, or Firm*—Nies, Kurz, Bergert & Tamburro

[57] ABSTRACT

Apparatus for the automatic refuelling of vehicles, primarily cars, including a robot which includes a robot head that is movable in relation to the robot so as to bring the robot head to a predetermined position in relation to the vehicle fuel tank pipe. The positioning of the robot head is effected by a positioning system which includes a first part located on the robot head and a second part placed in a predetermined position on the vehicle, wherein the robot head includes an outer tube and an inner tube which can be moved within said outer tube and extended out of said tube. The outer tube is resilient or yieldable, and the free, front end of the outer tube has the shape of a truncated cone that docks with a correspondingly conical part of an adapter attached to the upper orifice of the vehicle fuel tank pipe during said positioning operation. After the docking operation, the free forward end of the inner tube projects outwardly to a position down into the fuel-tank pipe, whereafter fuel is delivered to the fuel tank through the inner tube.

6 Claims, 3 Drawing Sheets

APPARATUS FOR AUTOMATIC REFUELLING OF VEHICLES

BACKGROUND OF THE INVENTION

1. Field of the Invention

The present invention relates to apparatus for the automatic refuelling of vehicles.

2. Description of the Related Art

Swedish Patent Specification No. 8901674-5 describes an apparatus for the automatic refuelling of vehicles, primarily cars, which includes a robot having a robot head provided with a fuelling nozzle or like device, and which is constructed to move the fuelling nozzle automatically from a rest position to a vehicle fuelling position in response to sensing and control means, and after the vehicle has been placed in a predetermined position relative to the robot.

According to that patent specification, the refuelling nozzle includes a rigid, first tubular element, preferably a metal tube, which is intended to be connected by the robot to an adapter which is provided with a hole and which is attached to the upper orifice of the vehicle fuel-tank pipe. A flexible, second tube, preferably of a plastic tube material, is arranged within the first, rigid tube for movement between a first end position in which the outer, free end of the second tube is located within the first tube, to a second end position in which the second tube projects out from the first tube. A tube connection is provided between said hole and the vehicle fuel-tank pipe. The robot is constructed to move the free end of the first tube into abutment with, or to a position in the immediate vicinity of the adapter in a first movement step and to move the free end of the second tube out of the first tube and down into said tube connection or down into the fuel-tank pipe of the vehicle in a second movement step, and to pump fuel through the second tube and down into the fuel tank of the vehicle in a third step. When fuelling of the vehicle is completed, the robot repeats the two first-mentioned steps, but in the reverse order.

A positioning system as mentioned in the aforesaid patent application includes a transceiver unit mounted on the robot head, which transceiver unit operates at microwave frequency, and a passive transponder is placed on the vehicle in a predetermined position relative to the fuel-tank pipe.

Although the robot head is positioned very accurately in relation to the vehicle fuel-tank flap, or cover plate, and therewith in relation to the fuel-tank pipe, the load acting on the vehicle can change from the time at which the robot head is initially positioned to the time at which fuelling of the vehicle is commenced. This change in load may be caused by a person leaving the vehicle, for instance.

Furthermore, when positioning the robot head it is necessary to be able to accept within accepted tolerances deviations caused by measuring errors or by an incorrectly positioned transponder on the vehicle.

It is thus desirable to be able to permit certain deviations between the ideal position of the robot head and the fuel-tank pipe when docking between the first, outer tube and the fuel-tank pipe, and the actual position occupied by the robot head immediately prior to docking.

Another problem is that docking must be monitored both prior to and during a fuelling operation, so that fuelling can be carried out in a safe manner.

These desiderata are fulfilled by the present invention.

SUMMARY OF THE INVENTION

The present invention thus relates to apparatus for the automatic refuelling of vehicles, preferably cars, including a robot having a robot head that is movable in relation to the robot so as to bring the robot head to a predetermined position in relation to the vehicle fuel tank pipe. The positioning of the robot head is effected by a positioning system which includes a first part located on the robot head and a second part placed in a predetermined position on the vehicle, wherein the robot head includes an outer tube and an inner tube which can be moved within said outer tube and out of said outer tube. The free, front end of the outer tube has a part in the shape of a truncated cone, said part being intended to be docked with a correspondingly conical part of an adapter, a truncated-conical part, during said positioning operation, said adapter being attached to the upper orifice of the fuel-tank pipe. Subsequent to said docking operation, the free forward end of the inner tube is intended to project out to a position down in the fuel-tank pipe, whereafter fuel is delivered to the fuel tank through the inner tube. The forward end of the inner tube has an essentially conical shape, and in said positioning operation, the inner tube has an axially displaced position relative to the outer tube such that the forward end of said inner tube will coact with the outer surface of the truncated cone of the outer tube to form a generally conical front part. The outer tube is resilient or yieldable so that said docking procedure is able to take place, provided that the tip of the inner tube is positioned radially inwards of the base of the conical part of the adapter.

BRIEF DESCRIPTION OF THE DRAWINGS

The invention will now be described in more detail partially with reference to exemplifying embodiments thereof shown in the accompanying drawings in which.

DESCRIPTION OF THE PREFERRED EMBODIMENTS

Figure 1:
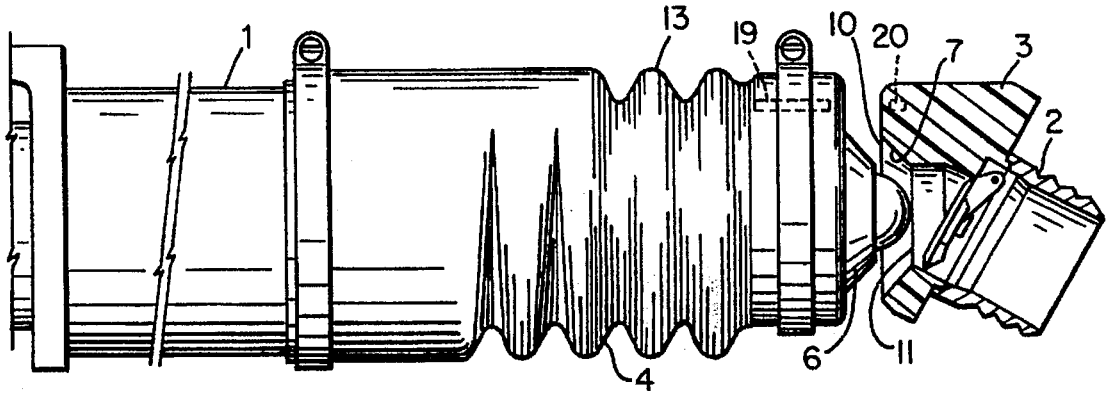
FIG. 1 is a side view of the front part of the robot head prior to final docking of the head with an adapter attached to a fuel-tank pipe.

FIG. 1 is a side view of the forward part of a robot head 1 and illustrates said part in a position prior to final docking of the robot head with an adapter 3 attached to the fuel-tank pipe 2 of the vehicle. The robot head belongs to a robot which is not shown in the Figure. The robot head 1 is movable in relation to the robot, so that the robot head can be brought to a predetermined position in relation to the fuel-tank pipe 2 of the vehicle, or more specifically in relation to the adapter 3.

The positioning is made by means of a positioning system which includes a first part located on the robot head and a second part which is placed in a predetermined position on the vehicle. The positioning system is preferably of the kind defined in the introduction, wherein the second part of the system is a passive transponder which is mounted on the vehicle in the vicinity of or actually on the vehicle fuel-tank flap. The positioning system, however, is not significant to the present invention.

Figure 2:
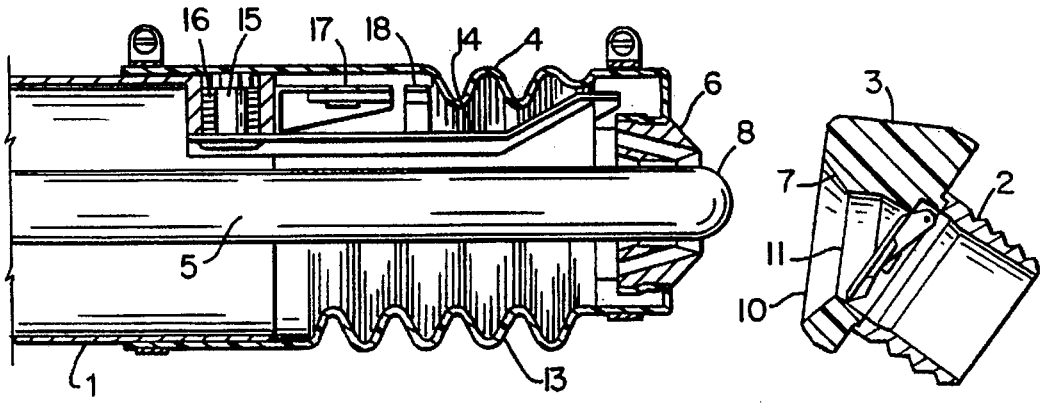
FIG. 2 is a cut-away view of the front part of the robot head.

The robot head includes a fuelling nozzle which, in turn, includes an outer tube 4 and an inner tube 5 which is able to move within the outer tube and out of said tube, see FIG. 2. The free, forward end of the outer tube 4 includes a part 6 in the form of a truncated cone, this part being intended to be docked with a corresponding conical part 7 in the form of a truncated cone on the adapter 3 attached to the upper orifice of the fuel-tank pipe during said positioning procedure. The free forward end 8 of the inner tube 5 is intended to be extended to a position further down in the fuel-tank pipe, see FIG. 6, upon completion of the docking procedure, whereafter fuel is delivered through the inner tube.

According to the invention, the aforesaid forward end 8 of the inner tube 5 has a generally conical configuration. When positioning the robot head relative to the fuel-tank pipe, the axially displaced position of the inner tube 5 relative to the outer tube 4 is such that the forward part 8 of the inner tube will coact with the outer surface of the truncated cone 6 of the outer tube so as to form a generally conical forward part of the robot head.

Figure 8:
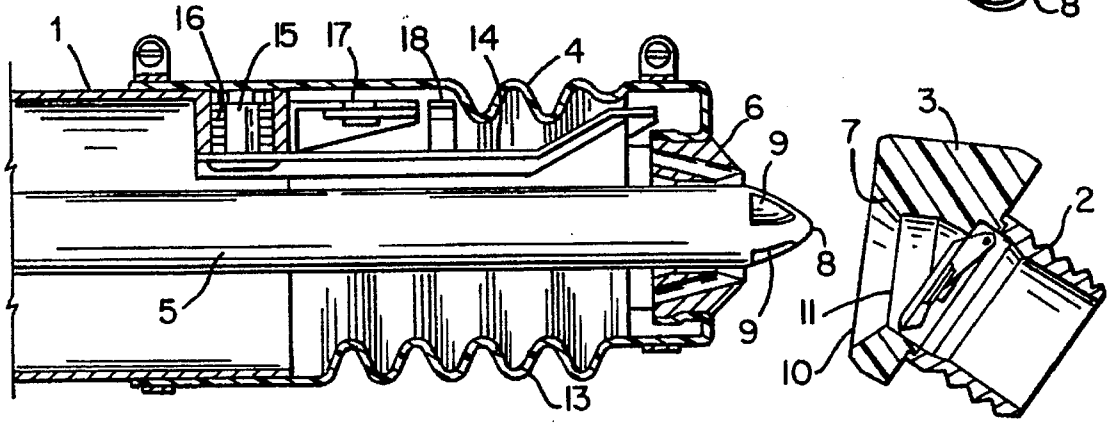
FIG. 8 illustrates an alternative configuration of the forward end of an inner tube.

As will be seen from FIG. 2, among other things the forward end 8 of the inner tube 5 is smoothly rounded so as to provide a blunt point. This rounded forward end, however, coacts with the conical part 6 of the outer tube and a generally conical front part of the robot head. FIG. 8 illustrates an alternative configuration of the forward end 8 of the inner tube, namely a configuration in which the forward end 8 is much more pointed and in which a more accurate fit in the frusto-conical part 7 is achieved.

Figure 7:
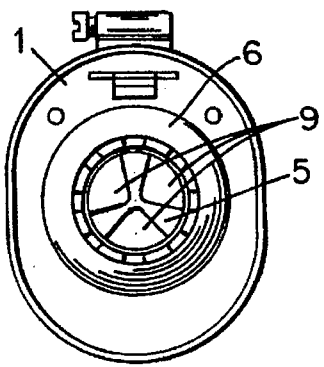
FIG. 7 illustrates the front part of the robot head, as seen from the right in FIG. 1.

As shown only in FIGS. 7 and 8, the inner tube 5 of both of these embodiments is provided with openings 9 in its forward end 8, which allow fuel to pass through the inner tube and into the fuel-tank of the vehicle.

According to the invention, the outer tube 4 is sufficiently resilient or yielding to enable docking to take place provided that the forward end 8 of the inner tube 5 is positioned radially within the base 10 of the conical part 7 of the adapter 3. When docking is completed, see FIG. 5, the conical surfaces 6, 7 of the robot head and the adapter, respectively, abut one another.

It is mentioned above that the outer tube 4 is sufficiently resilient or yielding to enable docking to take place provided that the forward end 8 of the inner tube 5 is positioned within the base 10 of the conical part 7 of the adapter 3, see FIG. 1. Provided that the inner tube 5 meets the conical part 7 of the adapter 3 as the inner tube 5 is projected out from the outer tube 4, the inner tube 5 will be guided down into the adapter 3 and therewith into the fuel-tank pipe 2. In the case when the forward end 8 of the inner tube does not come ideally into direct contact with the adapter opening 11 as the inner tube 5 is extended from the outer tube 4, it is necessary for the outer tube 4 to be deformed in order to enable the inner tube 5 to be guided down into the adapter 3.

Thus, the largest positional error of the robot head 1 relative to the fuel-tank pipe 2 that can be permitted is one in which the forward end 8 of the inner tube 5 is located within the base 10 of the conical part 7 of the adapter as the inner tube 5 is forwardly extended. According to the invention, the outer tube 4 shall be yieldable to an extent such as to allow effective docking to be achieved in the maximum permitted wrong positioning of the inner tube 5.

The base 10 of the conical part 7 of the adapter may have a relatively large diameter, for instance a diameter of from 5 to 10 centimeters.

Thus, the permitted positional error of the robot head 1 relative to the fuel-tank pipe 2, or to the adapter 3, is much greater than the largest positional error that occurs as a result of measuring errors obtained in the positioning system. The difference in the height position of a car caused by a person leaving the vehicle is only one or more centimeters. The positioning problem mentioned in the introduction is therewith solved by means of the present invention.

Figure 4:
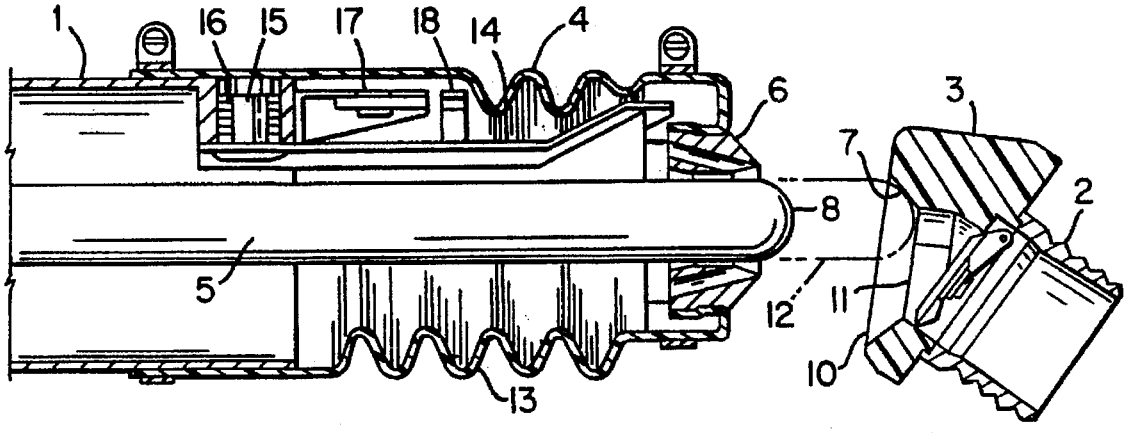
FIG. 4 illustrates ongoing docking between the forward part of the robot head and the adapter, and shows a deviation between the actual and the ideal position.
Figure 5:
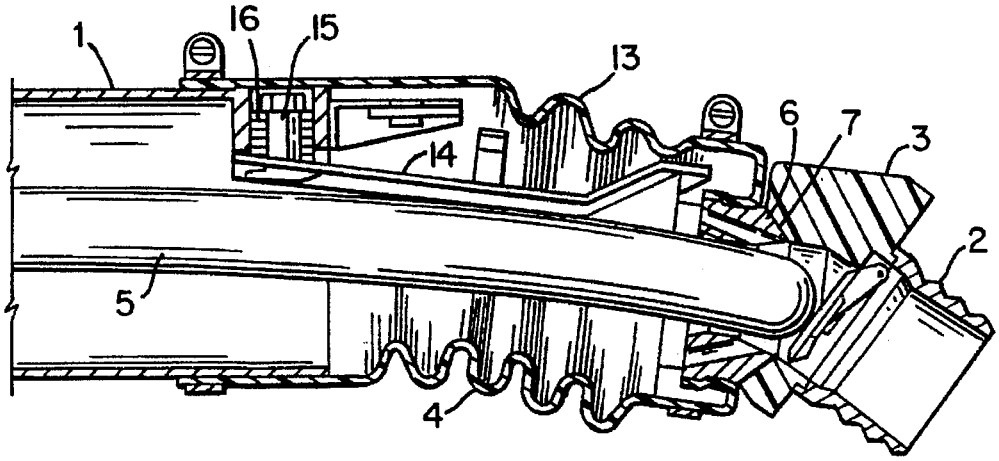
FIG. 5 illustrates the position of the robot head upon termination of the docking procedure shown in FIG. 4.
Figure 6:
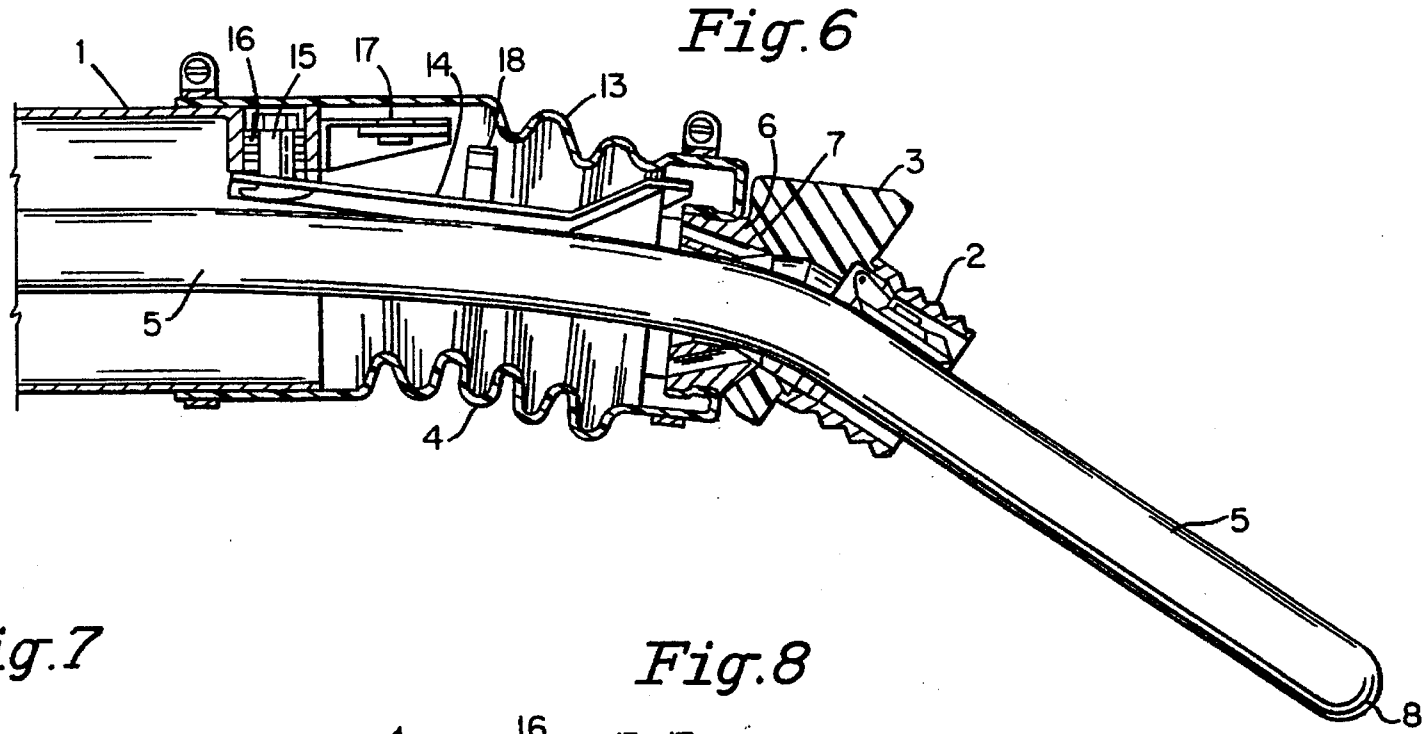
FIG. 6 illustrates conditions immediately prior to commencing a refuelling operation.

FIGS. 4 to 6 illustrate a docking operation. In FIG. 4 the broken line 12 illustrates the inner tube 5 subsequent to having been extended from the outer tube 4, wherewith the forward end 8 of the inner tube 5 lies against the conical part 7 of the adapter 3. When the inner tube 5 is further extended from the outer tube 4 (see FIG. 5), the conical surface of the adapter 3 will guide the inner tube 5 down into the adapter opening 11. Simultaneously therewith, the whole of the robot head 1 is moved forwards against the adapter 3, so that the conical part 6 of the outer tube 4 will come into abutment with the conical part 7 of the adapter 3 (see FIG. 5) so as to deform the outer tube 4 elastically. When docking has been completed, the inner tube 5 is further extended outwardly and down into the vehicle fuel-tank pipe 2 (see FIG. 6).

According to a preferred embodiment, the outer tube 4 is made of a relatively rigid plastic or rubber material, and the front part of the outer tube 4 includes a bellows-like section 13 which facilitates said deformation.

According to another preferred embodiment, the bellows-like section 13 is carried by a spring-loaded tab or plate 14 whose spring-loaded attachment point 15 is fixed in relation to the robot head 1 (see FIG. 2). The tab 14 is attached by means of a coil spring 16 of such strength as to support the outer tube 4 in a generally horizontal and predetermined position in the idle state of said tube. When the outer tube 4 is deformed in the aforesaid manner, the tab 14 will rotate around its attachment point 15 (compare FIGS. 4 and 5).

This latter embodiment obviates the need for the outer tube 4 to be self-supporting, thereby enabling the tube 4 to be made of a softer material, because the tube is supported by the tab 14.

The tab 14 is also rotatable about its attachment point 15 in a direction perpendicular to the plane of the paper.

According to one preferred embodiment, a position sensor 17, 18 is mounted at the tab attachment point 15, this sensor functioning to sense deviation of the tab 14 from its rest position, in which position no load acts on the outer tube ,4 i.e. the position shown in FIG. 2. The reference numeral 18 identifies a permanent magnet and the reference numeral 17 identifies a magnet sensor which is connected to a data processor belonging to the robot and controlling robot movement.

Because the tab 14 is bent down when the outer tube 4 is bent down and is rotated relative to the tab attachment point 15 when the outer tube 4 is moved in the horizontal plane, i.e., in a direction perpendicular to the plane of the paper, the position sensor 17, 18 is able to register permitted and unpermitted outward flexures of the outer tube 4. When the magnet 18 is distanced from the magnet sensor 17 to an extent which is slightly greater than that shown in FIG. 6, the magnet sensor 17 will send to the processor a signal which indicates that bending of the outer tube 4 is excessive.

Excessive bending of the outer tube 4 indicates that the robot head has been positioned incorrectly in relation to the adapter 3 fitted to the fuel-tank pipe 2.

Figure 3:
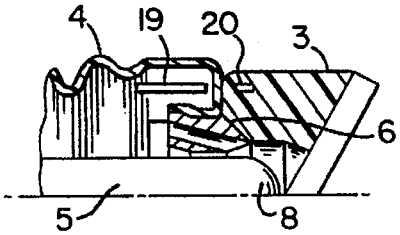
FIG. 3 illustrates a part of the forward part of the robot head and a part of the adapter.

According to another preferred embodiment of the invention (see FIGS. 1 and 3), there is provided on the forward end of the outer tube 4 a further sensor 19 which is intended to coact with a sensor 20 in the adapter 3. When docking is completed, the sensor 19 and the sensor 20 will be positioned opposite to one another, as shown in FIG. 3. This sensor 19 is also connected to the aforesaid processor and is intended to deliver a signal to the processor when docking is completed and during the duration of said docking.

The robot processor is constructed to permit fuel to be transported in the inner tube 5 only when the last-mentioned sensors 19, 20 and the first-mentioned sensors 17, 18 indicate that docking has been implemented and that outward bending of the outer tube 4 lies within the range permitted. This means that docking must be sufficiently accurate for fuel to be delivered and that refuelling is immediately interrupted should, for instance, the vehicle be driven away while refuelling is in progress. The sensors thus enable refuelling to be effected more safely.

Although the invention has been described with reference to different embodiments thereof, it will be understood that these embodiments can be modified in a number of ways, for instance with regard to the dimensions and construction of the robot head and adapter.

The present invention shall not therefore be considered limited to the aforedescribed and illustrated exemplifying embodiments thereof, since modifications and changes can be made within the scope of the following claims.

What is claimed is:

1. Apparatus for the automatic refuelling of vehicles comprising: a robot which includes a robot head that is movable in relation to the robot so as to bring the robot head to a predetermined position in relation to a vehicle fuel tank pipe, a positioning system for positioning the robot head during a positioning operation, the positioning system including a first part located on the robot head and a second part placed in a predetermined position on the vehicle, wherein the robot head includes an outer tube and an inner tube which can be moved within said outer tube and out of said outer tube, which outer tube is resilient and wherein a free, front end of the outer tube has a part in the shape of a truncated cone, said outer tube part being intended to be docked in a docking operation with a correspondingly truncated conical part of an adapter during said positioning operation, said adapter being adapted to be attached to an upper orifice of the fuel-tank pipe, and wherein subsequent to said docking operation, a free forward end of the inner tube is adapted to project out from the outer tube to a position down in the fuel-tank pipe, whereafter fuel is delivered to the fuel tank through the inner tube, wherein the forward end of the inner tube has an essentially conical shape and wherein in said positioning operation the inner tube has an axially displaced position relative to the outer tube such that the forward end of said inner tube will coact with an outer surface of the truncated cone of the outer tube to form a generally conical front part; and wherein the outer tube is resilient to such an extent that said docking operation can take place when the tip of the inner tube is positioned radially inwards of a base of the conical part of the adapter.

2. Apparatus according to claim 1, wherein the forward end of the inner tube includes surface openings through which fuel is able to pass out from the inner tube.

3. Apparatus according to claim 1, wherein the outer tube is made of a relatively rigid plastic or rubber material and has a bellows-like section adjacent its front end.

4. Apparatus according to claim 3, wherein the bellows-like section is supported by a spring-loaded tab including a spring-loaded attachment point that is fixed relative to the robot head.

5. Apparatus according to claim 4, including a sensor mounted at said attachment point, said sensor functioning to detect deviation of the tab from its rest position, in which no load acts on the outer tube.

6. Apparatus according to claim 1, wherein the front end of the outer tube carries a first sensor element which is adapted to coact with a second sensor element carried in the adapter, said first sensor element and said second sensor element being positioned so that they are opposite one another when docking is completed.

* * * * *